US005380085A

United States Patent [19]

Milek

[11] Patent Number: 5,380,085

[45] Date of Patent: Jan. 10, 1995

[54] CONCRETE MIXER WITH RECIPROCATING DISCHARGE CHUTE

[76] Inventor: Robert C. Milek, 6560 Stones Throw Dr., Omaha, Nebr. 68152

[21] Appl. No.: 226,501

[22] Filed: Apr. 12, 1994

[51] Int. Cl.[6] ..... B28C 5/20; B28C 7/16; B01F 15/02

[52] U.S. Cl. ..... 366/44; 366/57; 366/68; 366/193; 366/228; 366/233

[58] Field of Search ..... 366/42, 44, 53, 54, 366/56-59, 68, 184, 187, 188, 189, 193, 220, 225-231, 233, 606

[56] References Cited

U.S. PATENT DOCUMENTS

| | | | |
|---|---|---|---|
| 899,414 | 9/1908 | Koehring | 366/68 |
| 993,557 | 5/1911 | Scott | 366/188 |
| 1,056,249 | 3/1913 | Bathrick | 366/68 |
| 1,126,487 | 1/1915 | Koehring | 366/68 |
| 1,354,326 | 9/1920 | Moore | 366/188 |
| 1,477,543 | 12/1923 | Daniel | 366/68 |
| 1,555,172 | 9/1925 | Wege . | |
| 2,048,657 | 7/1936 | Jaeger . | |
| 2,395,571 | 2/1946 | McMillan | 366/220 X |
| 3,145,977 | 8/1964 | August . | |
| 3,915,439 | 10/1975 | Albin et al. . | |
| 4,382,682 | 5/1983 | Mendenhall | 366/57 X |
| 4,403,865 | 9/1983 | Fejmert | 366/44 |

FOREIGN PATENT DOCUMENTS

| | | | |
|---|---|---|---|
| 215085 | 10/1909 | Germany | 366/42 |

*Primary Examiner*—David A. Scherbel
*Assistant Examiner*—Charles Cooley
*Attorney, Agent, or Firm*—Zarley, McKee, Thomte Voorhees & Sease

[57] ABSTRACT

A horizontal drum concrete batch mixer comprising a cylindrical mixer drum which may be rotated in a mixing direction or a discharge direction. The interior of the drum has mixing blades provided thereon for mixing the concrete when the drum is rotated in its mixing direction. The interior of the drum is also provided with transfer blades which transfer the mixed concrete from the inlet end of the drum to the discharge end of the drum when the drum is rotated in its discharge direction. A discharge chute is movably positioned in the discharge opening formed in the discharge of the drum and is movable from a discharge position to a mixing position. A plurality of spaced-apart discharge blades are secured to the interior of the drum adjacent the discharge end thereof for delivering the mixed material into the discharge chute when the discharge chute is in its discharge position and the drum is rotated in its discharge direction.

9 Claims, 5 Drawing Sheets

CONCRETE MIXER WITH RECIPROCATING DISCHARGE CHUTE

BACKGROUND OF THE INVENTION

1. Field of the Invention

This invention relates to a concrete mixer and more particularly to a horizontal drum concrete batch mixer.

2. Description of Related Art

Historically, concrete has been mixed in many types of revolving drum mixers. Such mixers are powered either with gasoline engines or electrical motors. The drums normally are rotated in a single direction at a constant speed. Discharge from the mixer is sometimes accomplished by tilting a chute into the drum's interior. Such concrete mixers usually utilize a horizontally disposed and rotatably mounted mixing drum. Such horizontal drum mixers are limited in production capacity due to the excessive time required for the discharge of the mixed concrete therefrom.

As mixer and production capacity requirements have steadily increased, the trend in the industry has been to resort to a tilting type mixer configuration. High capacity tilting mixers have been the accepted design in the concrete industry for many years with the chief advantage being high production capacity due to the fast discharge rate as the mixer body is tilted toward its cone-shaped discharge end Such tilting mixers, however, are less portable and require substantial foundations to prevent overturning of the mixer as the mixer tilts beyond the supporting framework during discharge.

In portable applications, tilting mixers are at a further disadvantage due to their physical size. For example, in some tilting mixers, the discharge cone must be removed for transport to come within highway width limits. Further, the weight, power requirements, and cost of tilting mixers is greatly increased by the necessary addition of the powered tilting mechanism.

SUMMARY OF THE INVENTION

A concrete batch mixer is disclosed which includes a horizontally disposed, hollow mixer drum including a cylindrical shell having first and second end walls at the opposite ends thereof. The first end wall of the mixer drum has an inlet opening formed therein for introducing concrete materials into the mixer drum. An exhaust tube is operatively connected to the inlet to prevent the escape of dust into the atmosphere. The second end wall of the mixer drum has a discharge opening formed therein for discharging the mixed concrete therefrom. An electric motor is operatively connected to the drum for rotating the mixer drum in a first mixing direction and a second discharge direction. The mixer drum also has a plurality of spaced-apart transfer blades positioned in the interior thereof for transferring the mixed concrete towards the second end wall when the mixer drum is rotated in its discharge direction. The mixer drum also has a plurality of spaced-apart mixing blades secured to the transfer blade for mixing the concrete materials when the mixer drum is rotated in its mixing direction. A discharge chute is movably positioned in the discharge opening and is movable from a first non-discharge position to a second discharge position. The discharge chute includes a vertically disposed inner plate, a chute member extending outwardly from the inner plate, and a vertically disposed outer end plate. The chute member of the discharge chute extends outwardly through the outer end plate to facilitate the discharge of concrete. The inner end plate of the discharge chute closes and seals the discharge opening when the chute is in its non-discharge position. The outer end plate of the discharge chute is positioned adjacent the discharge opening when the discharge chute is in its discharge position. The open upper end of the chute member of the discharge chute is positioned inwardly of the discharge opening when the discharge chute is positioned in its discharge position. A plurality of spaced-apart buckets or blades are secured to the interior surface of the mixer drum adjacent the discharge opening for delivering the mixed concrete into the open upper end of the chute member when the mixer drum is rotated in its discharge direction so that the mixed concrete is discharged from the mixer drum outwardly through the discharge chute. The mixer drum may be mounted on a trailer for transport to the job site.

It is therefore a principal object of the invention to provide a horizontal drum concrete batch mixer including a discharge chute which is movable with respect to the discharge opening of the drum.

Yet another object of the invention is to provide a horizontal drum concrete batch mixer which includes a novel means for delivering the mixed concrete into a movable chute member which may be moved between discharge and non-discharge positions.

Still another object of the invention is to provide a horizontal drum concrete batch mixer which has high discharge capabilities.

Still another object of the invention is to provide a horizontal drum concrete batch mixer having high mixing capability and high discharge capability thereby avoiding the necessity of tilting the drum for discharge.

Still another object of the invention is to provide a more economical and mechanically simple concrete mixer which is more easily transported and which requires less in the way of installation and foundation support at the job site.

Still another object of the invention is to provide a system that is more simple to manufacture and assemble due to its cylindrical shape with flat end plates as compared to tilting mixers which require cone ends and the necessary additional supporting framework to permit tilting to discharge.

Still another object of the invention is to provide a system which more efficiently contains and exhausts dust particles by end seals which remain engaged while those in tilting mixers must break away during discharge exposing the interior to atmosphere.

These and other objects will be apparent to those skilled in the art.

DESCRIPTION OF THE PREFERRED EMBODIMENT

Figure 1:
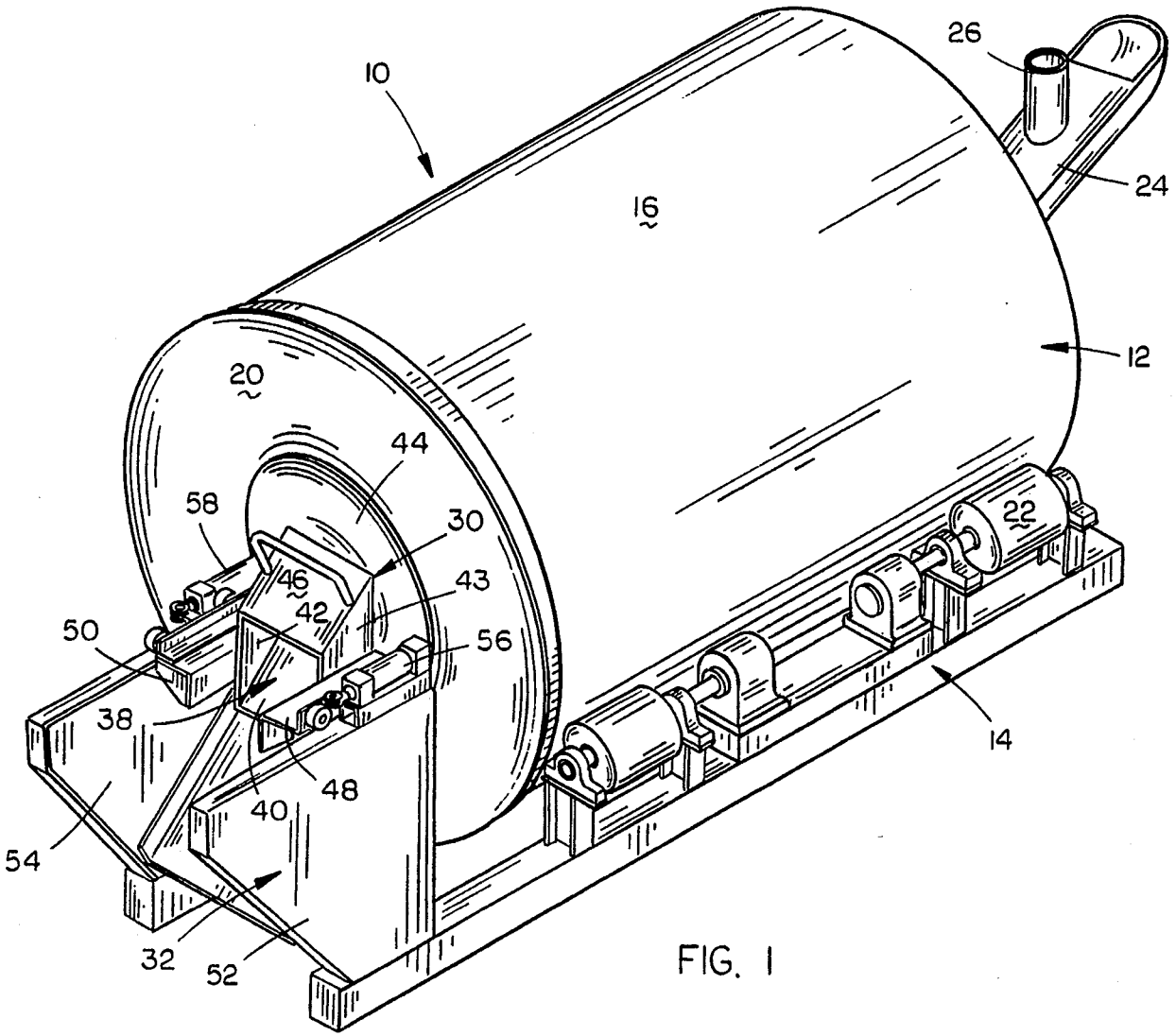
FIG. 1 is a perspective view of the horizontal drum concrete batch mixer of this invention.
Figure 3:
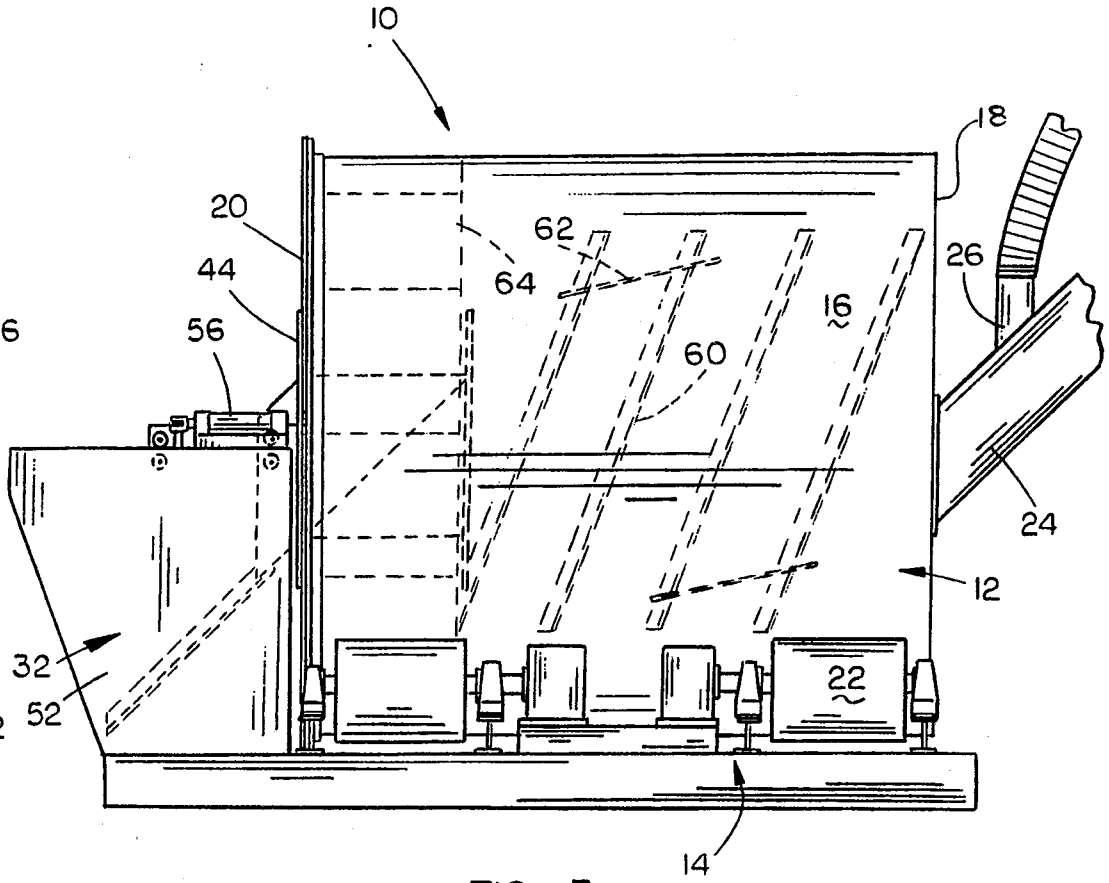
FIG. 3 is a side elevational view of the mixer.
Figure 2:
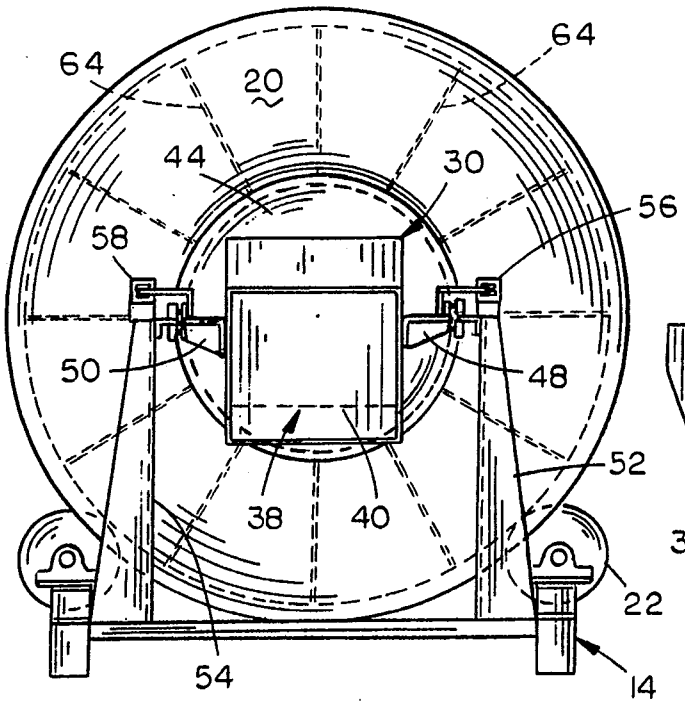
FIG. 2 is an end elevational view of the mixer.

The horizontal drum concrete batch mixer of this invention is referred to generally by the reference numeral 10 and includes a horizontally disposed drum 12 rotatably mounted on a frame means 14. For purposes of description, drum 12 will be described as including a cylindrical portion 16 having an inlet end wall 18 and a discharge end wall 20.

A plurality of horizontally disposed drive rollers 22 support the drum 12 and are operatively connected to a suitable power source for rotating the drum in a first mixing direction and an opposite discharge direction as will be described in more detail hereinafter.

Inlet end wall 18 is provided with an inlet chute 24 which communicates with the interior of the drum 12 to enable the concrete materials to be delivered to the interior of the drum. An elongated flexible exhaust tube 26 is in operative communication with the inlet chute 24 for exhausting dust therefrom to prevent the escape of the same to the atmosphere.

Discharge end wall 20 is provided with a centrally disposed circular opening 28 formed therein in which is movably mounted a discharge chute 30. As seen in FIG. 1, discharge chute 30 is movably mounted on a supporting frame 32 which extends upwardly from the frame means 14. Discharge chute 30 includes an inner end plate 34 which is disc-shaped and which has a diameter greater than the diameter of the opening 28. Inner end plate 34 is provided with a peripheral seal 36 extending around its outer surface which is adapted to sealably engage the inner surface of discharge end wall 20 when the discharge chute 30 is in the mixing position illustrated by solid lines in FIG. 4.

Figure 4:
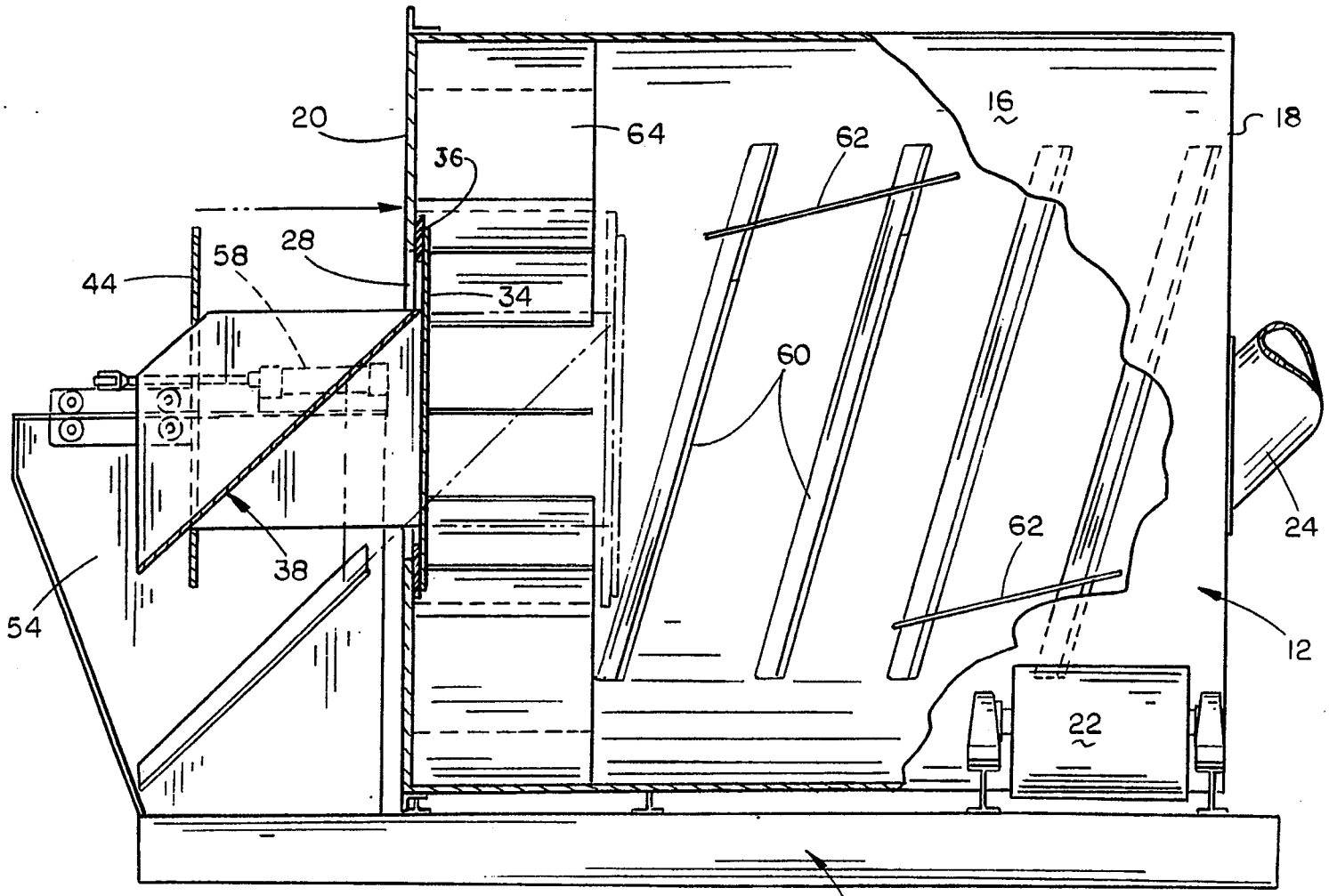
FIG. 4 is a view similar to FIG. 3 except that portions have been cut away to more fully illustrate the invention.

A substantially U-shaped chute member 38 extends outwardly from inner end plate 34 and includes a bottom wall 40 and opposite side walls 42 and 43. Chute member 38 extends downwardly and outwardly from the inner end plate 34 as illustrated in FIG. 4. The numeral 44 refers to an outer end plate of the discharge chute which is secured to the chute member 38 as illustrated in FIGS. 1 and 4 Chute member 38 is open at its upper end between inner end plate 34 and outer end plate 44. As seen in FIG. 1, chute member 34 is enclosed by a top portion 46 outwardly of outer end plate 44. Outer end plate 44 is adapted to sealably engage the outer surface of end wall 20 of drum 12 when the discharge chute 30 has been moved inwardly into the drum for discharge purposes as will be described in more detail hereinafter.

Discharge chute 30 includes a pair of slide members 48 and 50 which roll upon the upper surfaces of the frame members 52 and 54 of frame 32 as illustrated in FIG. 1. A pair of hydraulic cylinders or the like are operatively connected to the slide members 48 and 50 respectively as illustrated in FIG. 1 and are referred to generally by the reference numerals 56 and 58. The hydraulic cylinders 56 and 58 are adapted to move the discharge chute 30 from the mixing position illustrated by solid lines in FIG. 4 to the discharge position illustrated by broken lines in FIG. 4. The interior of drum 12 is provided with a plurality of spaced-apart transfer blades 60 which extend around the interior of the cylindrical portion 16 as illustrated in the drawings. As seen in the drawings, the transfer blades 60 are disposed at an angle with respect to the longitudinal axis of the drum 12 so that the blades will tend to maintain the contents in the drum towards the inlet end of the drum during the mixing operation but which are designed to transfer the mixed concrete towards the discharge end of the drum when the drum is rotated in its discharge direction. A plurality of spaced-apart mixing blades 62 are secured to the transfer blade 60 as illustrated in the drawings and are designed to mix the concrete in the drum as the drum is rotated in its mixing direction.

Figure 5:
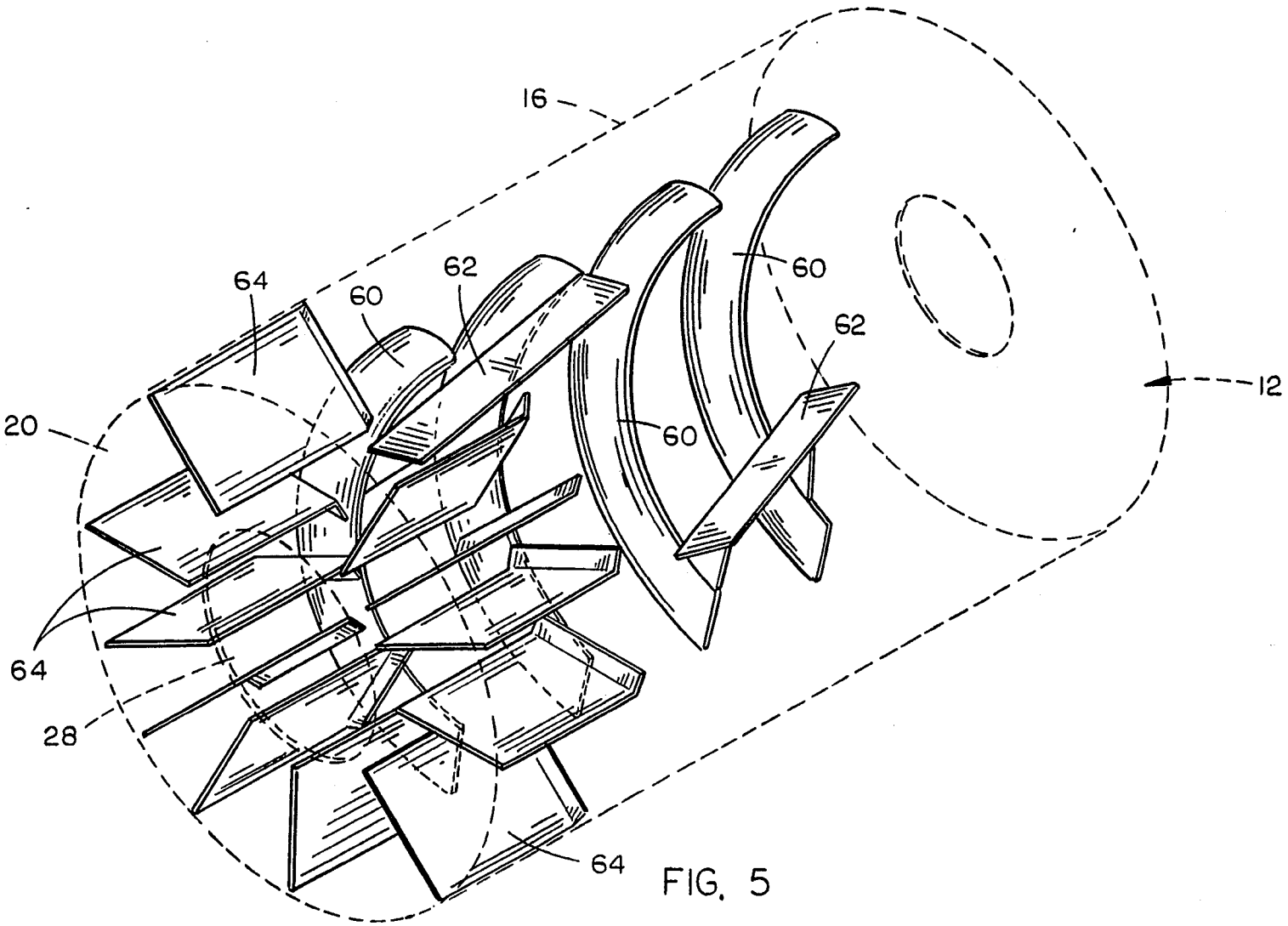
FIG. 5 is a partial perspective view illustrating the internal transfer blades, mixing blades and discharge buckets.

A plurality of spaced-apart discharge blades or buckets 64 are secured to the interior surface of drum 12 adjacent discharge end wall 20 as best illustrated in FIGS. 4 and 5. The discharge blades or buckets 64 extend around the discharge opening 28 and are designed to dump or drop the mixed concrete into the open upper end of the chute member 38 when the discharge chute 30 is in its discharge position and the drum 12 is rotated in its discharge direction.

Figure 6:
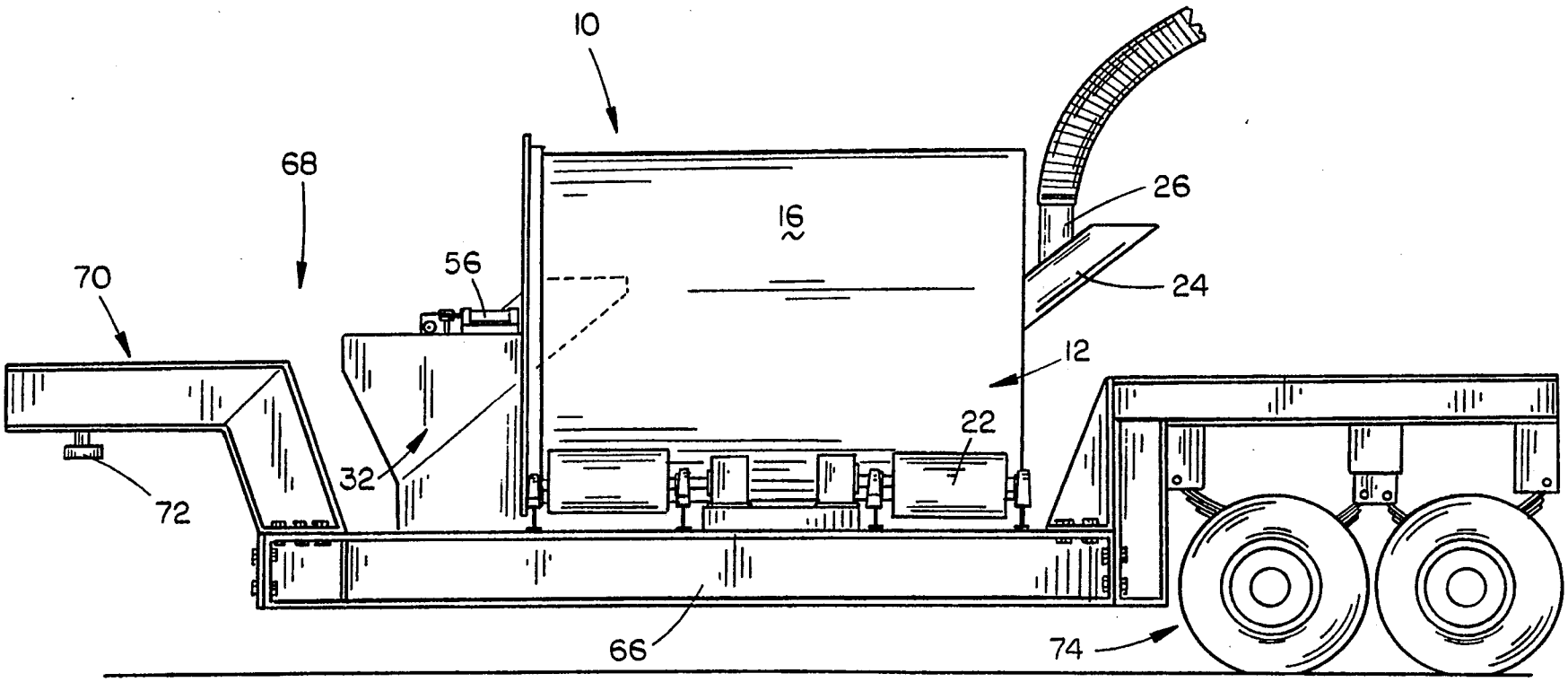
FIG. 6 is a side view illustrating the mixer mounted on a mobile chassis.

FIG. 6 illustrates the horizontal drum concrete batch mixer 10 of this invention mounted on a mobile chassis for transportation purposes to the job site. As seen in FIG. 6, mixer 10 is mounted on a bed 66 of a mobile chassis 68 which is in the form of a trailer. Chassis 68 includes a hitch means 70 at its forward end which is bolted to the bed 68 and which includes a king pin 72 provided thereon for connection to the fifth wheel of a truck or the like. The numeral 74 refers to a running gear assembly which is bolted to the rear of the bed 66 as illustrated in FIG. 6. Thus, the mixer 10 may be mounted on the mobile chassis or trailer 68 and transported to the desired job site. When the mixer 10 has been transported to the job site, the hitch means 60 and running gear assembly 74 may be removed from the bed 66 with the bed 66 being placed on a suitable supporting surface.

In operation, the discharge chute 30 is normally in the position illustrated by solid lines in FIG. 4. The power means for the mixer will normally be activated to rotate the drum 12 in its mixing direction. The materials for the concrete are then delivered to the interior of the drum 12 through the inlet chute 24. The rotation of the drum 12 by the power means causes the components of the concrete to be mixed through the action of the mixing blades 62. During the mixing operation, the transfer blades 60 tend to maintain the concrete in the drum towards the inlet end of the mixer drum. During the mixing operation, the inner end plate 34 of discharge chute 30 sealably engages the interior surface of the discharge end wall 20 around discharge opening 28 to prevent the escape of materials therethrough. The exhaust tube 26 also prevents the escape of dust to the atmosphere.

When the concrete has been mixed and it is desired to discharge the concrete from the drum 12, the rotation of the drum is reversed from its mixing direction to its discharge direction. The hydraulic cylinders 56 and 58 are then actuated to cause the discharge chute 30 to be moved inwardly with respect to the drum 12 from the position illustrated by solid lines in FIG. 4 to the position illustrated by broken lines in FIG. 4. The discharge position of the discharge chute 30 is also illustrated in FIG. 1. As the drum 12 is rotated in its discharge direction, the transfer blades 60 transfer the concrete in the drum towards the discharge end thereof. The discharge blades or buckets 64 pick up the concrete in the drum and move the same upwardly as the drum is rotated. As each discharge blade or bucket 64 moves towards its vertically disposed position above the open upper end of the chute member 38, the concrete thereon falls downwardly therefrom into the open upper end of the chute member 38. The mixed concrete which falls into the chute member 38 then passes outwardly through the chute member 38. During the discharge operation, the outer end plate 44 sealably engages the outer surface of the discharge end wall 20 of drum 12 to prevent the escape of materials from the drum other than through the discharge chute 30.

Thus it can be seen that a novel horizontal drum concrete batch mixer has been provided which has a large capacity and which does not require the tilting of the drum during discharge. The mixer of this invention not only has high mixing capability but also has high discharge capability. Thus it can be seen that the invention accomplishes at least all of its stated objectives.

I claim:

1. A concrete batch mixer comprising:

a horizontally disposed, hollow cylindrical mixer drum having first and second end walls at the opposite ends thereof;

said first end wall having an inlet opening formed therein for introducing concrete materials into said mixer drum;

said second end wall having a discharge opening formed therein for discharging the mixed concrete from said mixer drum;

means for rotating said mixer drum in a first mixing direction and a second discharge direction;

said mixer drum having mixing blades provided in the interior thereof for mixing the concrete materials therein when said mixer drum is rotated in its said first mixing direction;

said mixer drum including means in the interior thereof for transferring the mixed concrete materials towards said second end wall when said mixer drum is rotated in said second discharge direction;

a discharge chute selectively movably positioned in said discharge opening and including inner and outer ends;

said discharge chute being selectively movable from a first non-discharge position to a second discharge position;

said discharge chute including a vertically disposed inner end plate, a chute member extending outwardly from said inner end plate, and a vertically disposed outer end plate;

said chute member extending outwardly through said outer end plate;

said chute member having an open upper end between said inner and outer end plates for receiving mixed concrete materials therein when said discharge chute is in its said discharge position;

said inner end plate closing said discharge opening when said discharge chute is in its said non-discharge position;

said outer end plate being positioned adjacent said discharge opening when said discharge chute is in its said discharge position;

said open upper end of said chute member being positioned inwardly of said discharge opening when said discharge chute is positioned in its said discharge position;

and means provided in the interior of said mixer drum adjacent said second end wall for delivering the mixed concrete into said open upper end of said chute member when said mixer drum is rotated in its said second discharge direction, so that the mixed concrete is discharged from said mixer drum outwardly through said discharge chute.

2. The concrete batch mixer of claim 1 wherein said means provided in the interior of said mixer drum for delivering the mixed concrete into said chute member comprises a plurality of spaced-apart discharge buckets secured to the interior surface of said mixer drum adjacent said second end wall.

3. The concrete batch mixer of claim 1 wherein said inner end plate seals said discharge opening when said discharge chute is in its said non-discharge position.

4. The concrete batch mixer of claim 3 wherein said discharge opening is circular and wherein said inner end plate is disc-shaped and is received in said discharge opening when said discharge chute is in its said non-discharge position.

5. The concrete batch mixer of claim 4 wherein said outer end plate is disc-shaped and has a larger diameter than said discharge opening to close said discharge opening, except for said chute member extending through said discharge opening, when said discharge chute is in its said discharge position.

6. The concrete batch mixer of claim 1 wherein an inlet chute is in communication with said inlet opening and wherein a dust exhaust tube is in communication with said inlet chute.

7. The concrete batch mixer of claim 1 wherein a power means is secured to said discharge chute for moving said discharge chute between its said discharge and non-discharge positions.

8. The concrete batch mixer of claim 7 wherein said power means comprises a power cylinder.

9. In combination:

a wheeled trailer including a bed portion, a running gear portion, and a hitch portion:

said bed portion, said gear portion and said hitch portion being removably connected together to permit said bed portion to be placed upon a supporting surface;

and a concrete batch mixer mounted on said bed portion;

said concrete batch mixer comprising:

a horizontally disposed, hollow cylindrical mixer drum having first and second end walls at the opposite ends thereof;

said first end wall having an inlet opening formed therein for introducing concrete materials into said mixer drum;

said second end wall having a discharge opening formed therein for discharging the mixed concrete from said mixer drum;

means for rotating said mixer drum in a first mixing direction and a second discharge direction;

said mixer drum having mixing blades provided in the interior thereof for mixing the concrete materials therein when said mixer drum is rotated in its said first mixing direction;

said mixer drum including means in the interior thereof for transferring the mixed concrete materials towards said second end wall when said mixer drum is rotated in said second discharge direction;

a discharge chute selectively movably positioned in said discharge opening and including inner and outer ends;

said discharge chute being selectively movable from a first non-discharge position to a second discharge position;

said discharge chute including a vertically disposed inner end plate, a chute member extending outwardly from said inner end plate, and a vertically disposed outer end plate;

said chute member extending outwardly through said outer end plate;

said chute member having an open upper end between said inner and outer end plates for receiving mixed concrete materials therein when said discharge chute is in its said discharge position;

said inner end plate closing said discharge opening when said discharge chute is in its said non-discharge position;

said outer end plate being positioned adjacent said discharge opening when said discharge chute is in its said discharge position;

said open upper end of said chute member being positioned inwardly of said discharge opening when said discharge chute is positioned in its said discharge position;

and means provided in the interior of said mixer drum adjacent said second end wall for delivering the mixed concrete into said open upper end of said chute member when said mixer drum is rotated in its said second discharge direction, so that the mixed concrete is discharged from said mixer drum outwardly through said discharge chute.

* * * * *